US005905754A

United States Patent [19]

Dratner et al.

[11] Patent Number: 5,905,754

[45] Date of Patent: May 18, 1999

[54] AUTOMATIC SYSTEM FOR CONNECTION OF PNEUMATIC AND HYDRAULIC HOSES ON A COMPOSITE ELECTRODE FOR ARC FURNACES

[75] Inventors: Johannes Dratner, Castrop Rauxel, Germany; Gianni Gensini, Buia, Italy

[73] Assignee: Danieili & C. Officine Meccaniche SpA, Buttrio, Italy

[21] Appl. No.: 08/807,158

[22] Filed: Feb. 27, 1997

[30] Foreign Application Priority Data

Feb. 29, 1996 [IT] Italy ..... UD96A0027

[51] Int. Cl.[6] ..... H05B 7/10

[52] U.S. Cl. ..... 373/100; 373/92; 373/93; 373/94

[58] Field of Search ..... 373/93, 94, 106, 373/100, 92, 88

[56] References Cited

U.S. PATENT DOCUMENTS

| | | | |
|---|---|---|---|
| 4,397,026 | 8/1983 | Fuchs | 373/92 |
| 4,672,628 | 6/1987 | Hill | 373/93 |
| 4,853,942 | 8/1989 | Celada-Salmon . | |
| 5,200,974 | 4/1993 | Karl et al. | 373/94 |

FOREIGN PATENT DOCUMENTS

| | | |
|---|---|---|
| 0167485 | 1/1986 | European Pat. Off. . |
| 695343 | 4/1940 | Germany . |

*Primary Examiner*—John A. Jeffery
*Assistant Examiner*—Quang Van
*Attorney, Agent, or Firm*—Antonelli, Terry, Stout & Kraus, LLP

[57] ABSTRACT

System for connection of pneumatic and/or hydraulic hoses (11) on composite electrodes (12) for arc furnaces, the electrodes (12) comprising, at least one hollow adapter (13) associated at their lower part with a replaceable graphite element (14), the electrode (12) cooperating with an electrode-holder arm (15) and being displaceable axially in relation to that electrode-holder arm (15), the hoses (11) being associated at one end with a first connection assembly (18*a*) associated with a support (17), the adapter (13) including a solidly attached second connection assembly (18*b*) mating functionally with the first connection assembly (18*a*), the first (18*a*) and second (18*b*) connection assemblies comprising mating connecting elements (19*a*, 19*b*) equipped with elements to interrupt the flow of the fluid which can be temporally actuated, the a support (17) associated with the first connection assembly (18*a*) having a first inactive position temporally solid with the electrode-holder arm (15) and a second working position released from the electrode-holder arm (15) and temporally solid with the second connection assembly (18*b*) associated with the adapter (13), the transition from the first inactive position to the second working position of the support (17) taking place according to the position of the electrode (12) in a defined position of engagement/disengagement.

10 Claims, 2 Drawing Sheets

AUTOMATIC SYSTEM FOR CONNECTION OF PNEUMATIC AND HYDRAULIC HOSES ON A COMPOSITE ELECTRODE FOR ARC FURNACES

BACKGROUND OF THE INVENTION

This invention concerns an automatic system for connection of pneumatic and hydraulic hoses on composite electrodes for arc furnaces.

To be more exact, the automatic connection system according to the invention is employed for the connection of the hoses conveying cooling and actuation fluids to the cooled adapter element on electrodes of a composite type used in electric arc furnaces.

The invention is used both in electric arc furnaces fed with direct current and those fed with alternating current.

The system according to the invention assists, accelerates and automates the operations of connection/disconnection of the hydraulic and pneumatic hoses during the steps of removal and replacement of the electrodes.

Moreover, the system according to the invention does not cause any impediment to the vertical movement of the electrodes during the operational steps of the furnace in that, at least during these operational steps, the connection assembly of the hydraulic and pneumatic hoses is integrated with the electrode and moves vertically with the same.

The state of the art includes composite electrodes formed with a hollow cylindrical adapter made of a metallic material and secured to the respective electrode-holder arm; to the lower end of the adapter element is fixed a consumable cylindrical graphite element from which the electric arc strikes.

The electrode of a composite type provides various advantages as compared to those made entirely of graphite; the adapter in a furnace fed with direct current may have the function of an auxiliary reactor, thus reducing the size and complexity of the external reactors normally used in the plant that supplies such furnaces.

The adapter, appropriately dimensioned, in a furnace fed with alternating current enables the currents circulating in the three phases to be balanced, thus reducing the drawbacks of the state of the art arising from an unbalanced system.

A further advantage provided by the use of composite electrodes is that they may not require previous processing for adaptation of the graphite element, for such processing is necessary, instead, for electrodes made completely of graphite; the reason for this is that the electrode is supported by the electrode-holder arm at the adapter and not at the graphite element.

The lack of previous processing makes possible a great saving of material, costs and processing times.

On the other hand, such composite electrodes require a system for cooling the adapter so as to prevent the latter being capable of being damaged owing to the high temperature of the furnace.

The cooling of the adapter is normally carried out by circulating within it a cooling fluid, normally air or water, which is fed through external hoses.

According to the state of the art these hoses are free and flexible and are secured at one end to the upper part of the adapter.

However, it is known that the electrodes during the working cycle have to be able to slide axially in relation to the electrode-holder arm so as to adjust the height of the electrodes in relation to the bath of molten metal according to the wear of the graphite segment and also have to be capable of being readily dismantled quickly so as to make possible the normal operations of maintenance and replacement of the graphite segment.

The cooling hoses form a great hindrance as they have to be disconnected to perform the operations of removal of the electrode.

In fact, while the adjustment of the axial position of the electrode is possible, the dismantling of the electrode is especially difficult since the disconnection of the hoses has to be carried out by hand.

Moreover, to perform that operation, the machine operator has to clamber onto the electrode-holder arm and thus exposes himself to the risk of accidents and contravenes the specific safety rules in force.

So as to avoid this problem, the hoses are equipped with a connection means to suit the axial position of the electrode.

According to this embodiment the hoses are connected to a first connection assembly, which includes a plurality of elements connecting the hoses and is fixed solidly to the electrode-holder arm.

The adapter element of the electrode includes a second connection assembly, which is solidly fixed to the upper part of the adapter and mates with the first connection assembly and is connected to the cooling conduits located within the latter.

Both the connection assemblies include automatic closure means, which prevent the fluid contained therein from emerging from the hoses when the connection assemblies are disconnected.

When the electrode is lowered to its working position, the second connection assembly located on the electrode cooperates with the first connection assembly positioned on the electrode-holder arm, thus allowing the cooling fluid to circulate within the adapter.

Viceversa, when the electrode is raised to its inactive position, the two connection assemblies are disconnected and release the electrode.

This embodiment makes possible a ready dismantling of the electrode for carrying out maintenance and replacement of the graphite segment but does not make possible the adjustment of the axial position of the electrode inasmuch as every displacement of the electrode causes disengagement of the connection assemblies from each other and the resulting interruption of the circulation of cooling fluid.

EP-A-0167485 shows a device, substantially of the type described above, which serves to assist and accelerate the connection of the cooling water hoses after every replacement of the electrode.

This device comprises a connection assembly which is attached stationary to the electrode-holder arm; the assembly is connected on one side to the hoses which deliver the cooling water and on the other side includes apertures for the insertion of conduits for the supply of water, these conduits being connected to the adapter of the electrode.

There is also included a guide element, attached to the adapter, by means of which the conduits for the supply of water are guided inside the connection assembly, during the step of positioning the new electrode, until the conduits are connected with the delivery hoses.

This embodiment, if it does on the one hand assist the operations of connecting the various elements every time the electrode is changed, does not allow the electrode to be vertically moved, once the connections have been made, so as to adjust the length of the electrodes in the course of the melting process inside the furnace.

This is because the connection assembly is fixed on the electrode-holder arm and therefore cannot move with the electrode and follow its vertical movements of adjustment.

SUMMARY OF THE INVENTION

So as to overcome the shortcomings of the state of the art detailed above and to achieve further advantages, the present applicants have designed, tested and embodied this invention.

The purpose of this invention is to embody, in a composite electrode including a cooled adapter associated at the lower part with at least a graphite segment, a system for connection of the pneumatic or hydraulic hoses performing cooling and/or transmission of power, the system permitting fully automatic operations to connect/disconnect the various elements.

A further purpose of the invention is to achieve a system including an assembly to connect the hoses which, in the operational position of the electrode, is integrated with the cooled adapter and can therefore follow the movements of the electrode as it is vertically adjusted as the melting cycle of the furnace progresses and according to the progressive wear of the graphite segment.

According to the invention the system comprises a first connection assembly, to which are united the hoses conveying the cooling fluid and possibly also an actuation fluid.

This first connection assembly is associated with supporting means which have a first inactive position, assumed at least in the steps of replacement or maintenance of the electrode, where they are solidly attached to the relative electrode-holder arm by clamping means.

This secure positioning of the supporting means on the electrode-holder arm ensures that, all the time the electrode is disconnected from the furnace and the delivery of the cooling fluids is interrupted, the first connection assembly has a safe and stable position.

The system according to the invention also includes a second connection assembly, solidly associated with the adapter of the electrode, normally near the upper part of the adapter.

The configuration of this second connection assembly is substantially mating with the first connection assembly.

To be more exact, the second connection assembly includes connection apertures for the passage of the fluid, the apertures being located in positions which correspond to mating apertures on the first connection assembly.

Moreover, the second connection assembly includes connections with the conduits for the fluids, both cooling fluid and actuation fluid, inside the adapter.

The complementary apertures providing connection and the passage of the fluid, which are included in the first and second connection assemblies, are equipped with automatic closure devices which interrupt the passage of the fluid when they are not connected with each other.

Moreover, the first and second connection assemblies are equipped with reciprocal mating engagement/disengagement means which are actuated automatically.

In the system according to the invention, when the electrode is progressively lowered to be placed in its working position, the second connection assembly, solid with the adapter, is positioned in cooperation with the first connection assembly which at that moment is positioned stationary on the electrode-holder arm.

This position of cooperation causes automatically the release of the supporting means on the first connection assembly from the electrode-holder arm, and at the same time the engagement of the supporting means to the second connection assembly which is solid with the adapter.

In this way the first connection assembly assumes a second working position solid with the electrode, thus making possible the free movement and adjustment of the axial position of the electrode during the working cycle; all the hoses connected to the first connection assembly follow the electrode in its axial movement.

According to a variant the release of the supporting means of the first connection assembly from the electrode-holder arm, and the engagement of the supporting means to the adapter are remote-controlled during the step at which the electrode is lowered into its operating position and the first and second connection assemblies are in their position of reciprocal cooperation.

The disengagement of the electrode from the cooling hoses connected to the first connection assembly takes place in the reverse manner by re-positioning the electrode in the engagement/disengagement position.

At the same time and automatically, the supporting means of the first connection assembly are released from the adapter and are re-connected to the electrode-holder arm, thus making possible the release of the second connection assembly, which is solid with the adapter, from the first connection assembly and thus the dismantling and removal of the electrode.

BRIEF DESCRIPTION OF THE DRAWINGS

The attached figures are given as a non-restrictive example and show a preferred embodiment of the invention as follows.

DETAILED DESCRIPTION OF THE PREFERRED EMBODIMENTS

Figure 2:
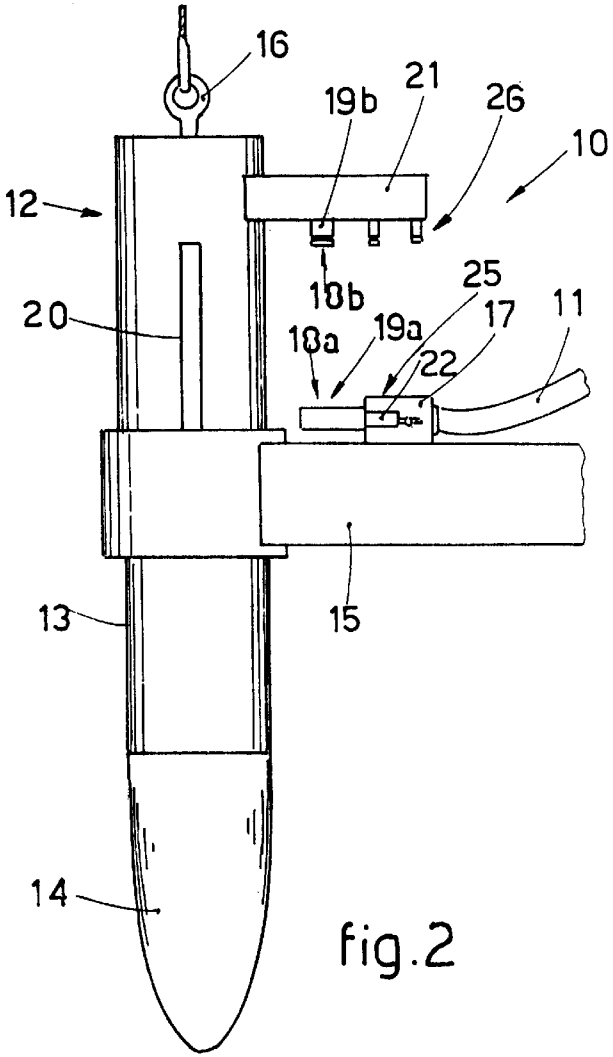
FIG.2 shows as an example a side view of the composite electrode of FIG.1 in its inactive position with the first connection assembly anchored to the electrode-holder arm.
Figure 1:
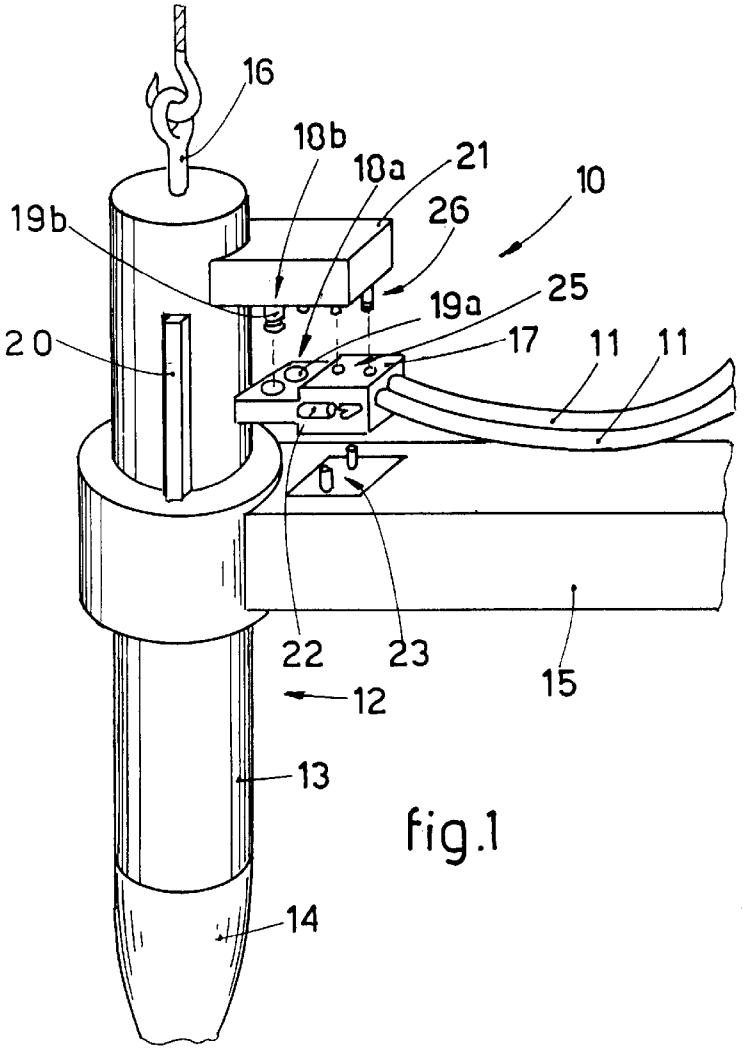
FIG.1 is a three-dimensional view of a composite electrode equipped with an automatic connection system according to the invention.

The reference number 10 in the attached figures denotes generically an automatic system as a whole for the connection of pneumatic or hydraulic hoses 11.

The reference number 12 denotes an electrode of a composite type which consists of a hollow cooled adapter 13 made of a metallic material and a consumable and replaceable segment 14 made of graphite.

The adapter 13 contains conduits, not shown here, for the transport and passage of cooling fluids and power supply.

The electrode 12 is supported by an electrode-holder arm 15 by means of a clamp and can slide axially in relation to the arm 15 so as to alter, as the melting cycle proceeds, the distance of the graphite segment 14 from the bath of molten metal inside the furnace; and to enable the electrode 12 to be removed when it is necessary to replace, maintain or integrate the graphite segments 14.

The lifting of the electrode 12 is carried out in a known manner by an appropriate crane by means of a hook 16.

According to the invention lower attachment means 23 are included on the electrode-holder arm 15, and supporting means 17 cooperate with these lower attachment means 23 by means of mating engagement means 24.

On the supporting means 17 there is a first connection assembly 18*a* to which are united the hoses 11 conveying cooling fluid and possibly a fluid to operate actuators or other actuation systems possibly included inside the adapter 13.

The first connection assembly 18*a* comprises a plurality of first connecting elements 19*a* equipped with means to interrupt the flow of the fluid which are not shown here.

A second connection assembly 18*b* is solidly fixed to the adapter 13 by means of a bracket support 21 and comprises a plurality of second connecting elements 19*b* which mate in number and in position with the first connecting elements 19*a* included in the first connection assembly 18*a*.

These second connecting elements 19*b* also include means to interrupt the flow of the fluid, which are not shown here. Guide means 20 are included on the adapter 13 and prevent rotation of the electrode 12, thus keeping the first and second connection assemblies 18*a*, 18*b* aligned during axial movement of the electrode 12.

Figure 3:
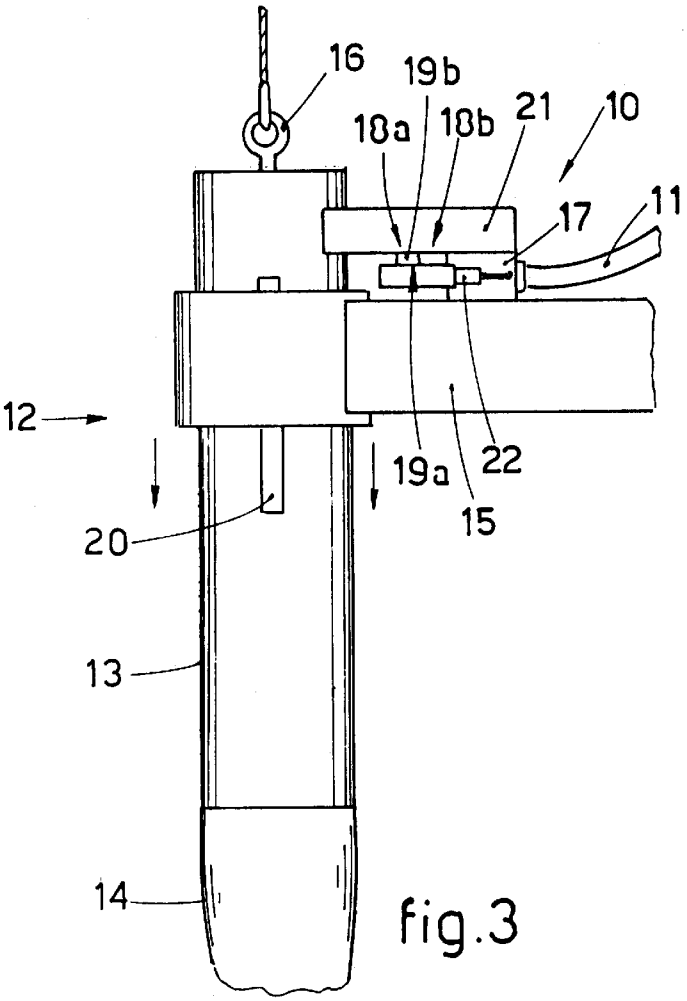
FIG.3 shows the same side view as FIG.2 with the electrode lowered to the engagement/disengagement position.

The electrode 12 is lowered from its raised inactive position, which may be caused by maintenance or replacement operations and which is shown in FIG.2, to its engagement/disengagement position shown in FIG.3, thus bringing the second connection assembly 18*b* to cooperate with the first connection assembly 18*a*.

In this case, a release actuator 22 positioned on the movable supporting means 17 causes the automatic disengagement of the movable supporting means 17 from the electrode-holder arm 15 and at the same time causes the movable supporting means 17 to engage with the support 21.

To be more exact, in this case this engagement takes place by means of automatic connection between the first engagement elements 25 included on the movable supporting means 17 and second attachment means 26 included on the lower side of the support 21.

According to one form of embodiment of the invention the actuation of the actuator 22 can be governed by a sensor 27 which identifies the end-of-travel position of the electrode 12, with the second connection assembly 18*b* located in cooperation with the first connection assembly 18*a*.

According to another embodiment of the invention this engagement/disengagement may be fully mechanical; the mere lowering of the electrode 12 causes mechanical engagement between the first and second connection assemblies 18*a*, 18*b*, while the raising of the electrode 12 causes mechanical disengagement between the first and second connection assemblies 18*a*, 18*b* according to a configuration analogous to that of pens or biros operated by a push button.

Once the first connection assembly 18*a* has been anchored to the second connection assembly 18*b* and therefore to the adapter 13, and once the relative connecting elements 19*a* and 19*b* have been connected, the means to interrupt the flow of the fluid are disactivated and the cooling fluid and the actuation fluid are allowed to flow.

The position of the first connection assembly 18*a* solid with the adapter 13 allows the electrode 12 to move axially in a completely independent manner, both from the position where the hoses 11 are connected and also from the position of the electrode-holder arm 15.

Figure 4:
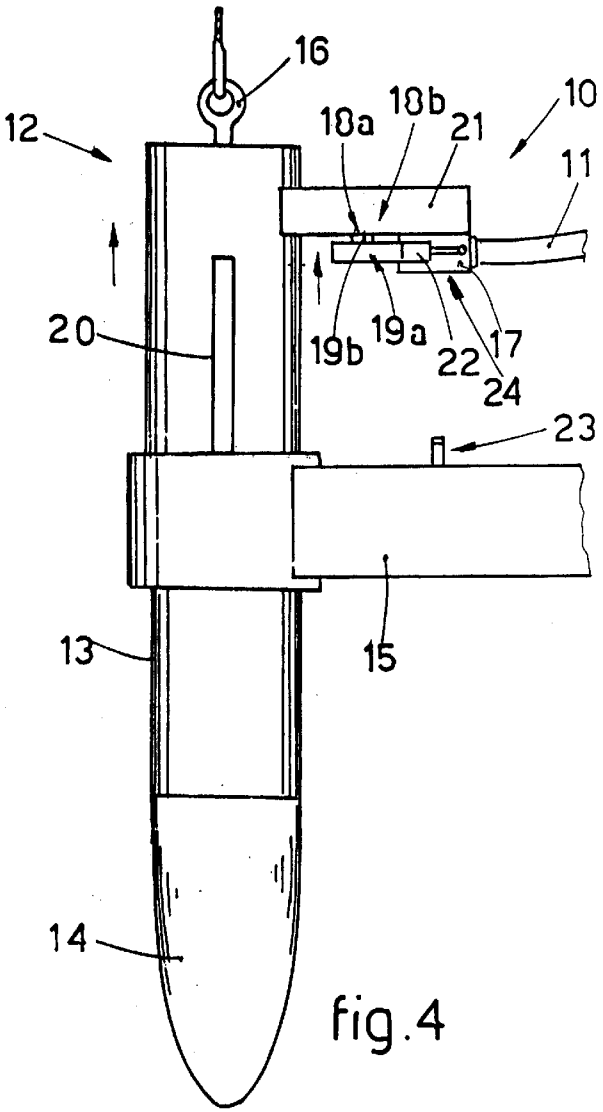
FIG.4 shows the same side view as FIG.2 with the first connection assembly secured to the electrode.

Fig.4 shows an example of a possible position which the electrode 12 may assume, as the first connection assembly 18*a* is solid with the electrode 12.

According to a variant the disengagement of the movable supporting means 17 from the electrode-holder arm 15 and the engagement of the movable supporting means 17 with the support 21 are performed by respective and separate actuators 22.

According to another variant the engagement/disengagement are remote-controlled by a machine operator.

The disengagement of the electrode 12 from the hoses 11 is carried out by re-positioning the electrode 12 in the engagement/ disengagement position, that is to say, by taking the supporting means 17 back to a position where they cooperate with the electrode-holder arm 15.

In this position, the disengagement actuator 22 releases the movable supporting means 17 from the bracket support 21 and at the same time re-attaches the movable supporting means 17 to the electrode-holder arm 15, thus permitting disengagement of the first and second connection assemblies 18*a*, 18*b* from each other, after re-activating the means to interrupt the flow of the fluids associated with the connecting elements 19*a*, 19*b*.

As described above, the system 10 for connection of the hoses 11 according to the invention takes place in a fully automatic manner without requiring manual action by the personnel on the electrode-holder arm 15;

This situation makes the operations to assemble and dismantle the electrode quick and safe and eliminates the problems described above and forming the subject of complaints of businessmen in this field for a long time now.

At the same time, the axial movement of the electrode 12 is in no way hindered or prejudiced during the operational steps of the furnace as the graphite segment is progressively consumed.

We claim:

1. System for connection of at least one of pneumatic hoses and hydraulic hoses on composite electrodes for arc furnaces, comprising at least one electrode, each electrode having at least one hollow adapter associated at its lower part with a replaceable graphite element, each electrode cooperating with an electrode-holder arm and being displaceable axially in relation to the electrode-arm, the hoses being associated at one end with a first connection assembly associated with supporting means, the adapter including a solidly attached second connection assembly mating functionally with the first connection assembly, the first and second connection assemblies comprising mating connecting elements equipped with elements to interrupt automatically a flow of fluid and able to be temporally activated, the system being characterised in that the supporting means associated with the first connection assembly has a first inactive position connected to the electrode-holder arm and a second working position released from the electrode-holder arm and connected to the second connection assembly, a transition from the first inactive position to the second working position of the supporting means taking place according to a position of the electrode in a defined position of engagement and disengagement.

2. System for connection as in claim 1, in which the supporting means includes lower engagement means temporally activated and cooperating, in the first inactive position, with mating lower attachment means included on the electrode-holder arm and includes also upper engagement elements, temporally activated and cooperating with mating attachment means included on the adapter in the second working position.

3. System for connection as in claim 2, in which the engagement between the upper engagement elements and mating attachment means takes place mechanically, according to the lowering of the electrode into the engagement and disengagement position.

4. System for connection as in claim 2, in which the upper engagement elements and lower attachment means of the supporting means are governed by at least one release actuator.

5. System for connection as in claim 4, in which the actuator is remote-controlled.

6. System for connection as in claim 4, in which the actuator is governed by a sensor that identifies the end-of-travel position of the electrode.

7. System for connection as in claim 1, in which the adapter comprises axial guide means able to align and center the first and second connection assemblies.

8. System for connection as in claim 4, in which at least one release actuator is of a hydraulic type.

9. System for connection as in claim 4, in which the attachment/release actuator (22) is of a pneumatic type.

10. System for connection as in claim 4, in which at least one release actuator (22) is of an electric type.

* * * * *

UNITED STATES PATENT AND TRADEMARK OFFICE

CERTIFICATE OF CORRECTION

PATENT NO : 5,905,754

DATED : May 18, 1999

INVENTOR(S) : Dratner et al

It is certified that error appears in the above-identified patent and that said Letters Patent is hereby corrected as shown below:

On title page, item 73 Assignee:
replace "Danieili & C. Officine Meccaniche SpA, Buttrio, Italy"
with --Danieli & C. Officine Meccaniche SpA, Buttrio, Italy--.

Signed and Sealed this

Fourth Day of July, 2000

*Attest:*

Q. TODD DICKINSON

*Attesting Officer*

*Director of Patents and Trademarks*